US006537187B1

(12) United States Patent
Gamberini

(10) Patent No.: US 6,537,187 B1
(45) Date of Patent: Mar. 25, 2003

(54) AUTOMATIC MACHINE FOR THE PREPARATION OF HALF-PACKAGES STARTING FROM CORRESPONDING BLANKS

(75) Inventor: Ernesto Gamberini, Rastignano (IT)

(73) Assignee: MG2 S.p.A., Pianoro (IT)

( * ) Notice: Subject to any disclaimer, the term of this patent is extended or adjusted under 35 U.S.C. 154(b) by 112 days.

(21) Appl. No.: 09/593,664

(22) Filed: Jun. 14, 2000

(30) Foreign Application Priority Data

Jun. 15, 1999 (IT) ..... BO99A0323

(51) Int. Cl.[7] ..... B31B 1/26

(52) U.S. Cl. ..... 493/162; 493/152; 493/180; 493/128

(58) Field of Search ..... 493/123, 125, 493/126, 127, 128, 150, 162, 180, 434, 442, 450

(56) References Cited

U.S. PATENT DOCUMENTS

| | | | | | |
|---|---|---|---|---|---|
| 2,737,863 | A | * | 3/1956 | Watson | 493/162 |
| 2,762,274 | A | * | 9/1956 | Kerr | 198/377.01 |
| 2,801,578 | A | * | 8/1957 | Bayley | 493/123 |
| 2,887,022 | A | * | 5/1959 | Lubersky et al. | 493/124 |
| 3,115,073 | A | * | 12/1963 | Kreimendahl | 493/128 |
| 3,312,155 | A | * | 4/1967 | Hickin | 229/145 |
| 3,461,642 | A | | 8/1969 | Langen et al. | 53/29 |
| 4,000,687 | A | * | 1/1977 | Adams | 493/312 |
| 4,056,046 | A | * | 11/1977 | Hughes | 493/12 |
| 4,563,169 | A | * | 1/1986 | Virta et al. | 493/126 |
| 5,558,611 | A | * | 9/1996 | Focke | 493/162 |

FOREIGN PATENT DOCUMENTS

| | | |
|---|---|---|
| EP | 0286846 | 10/1988 |
| EP | 0906865 A1 | 4/1999 |
| FR | 2259014 | 8/1975 |

* cited by examiner

*Primary Examiner*—Scott A. Smith
*Assistant Examiner*—Chukwurah Nathaniel

(57) ABSTRACT

An automatic machine for the preparation of half-packages starting from corresponding blanks preferably made of cardboard, the automatic machine comprising:

a frame;

at least one mould designed to receive a blank;

a feed device for feeding the mould along a pre-defined path; and a plurality of devices set along the path for folding respective portions of the blank on the mould so as to form a corresponding half-package; the automatic machine being characterized in that at least one part of the plurality of devices is fixed with respect to the frame and to the feed device and in that a device is provided which is designed to maintain the faces of the mould constantly parallel to themselves at any point of the path.

24 Claims, 9 Drawing Sheets

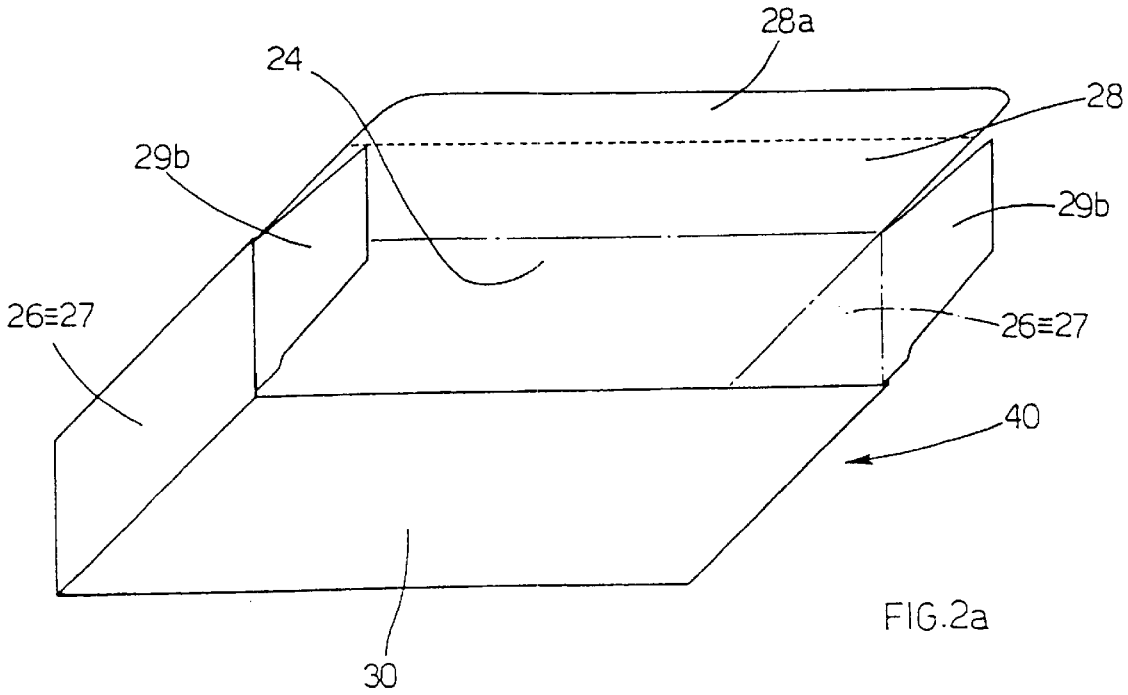
FIG.2a
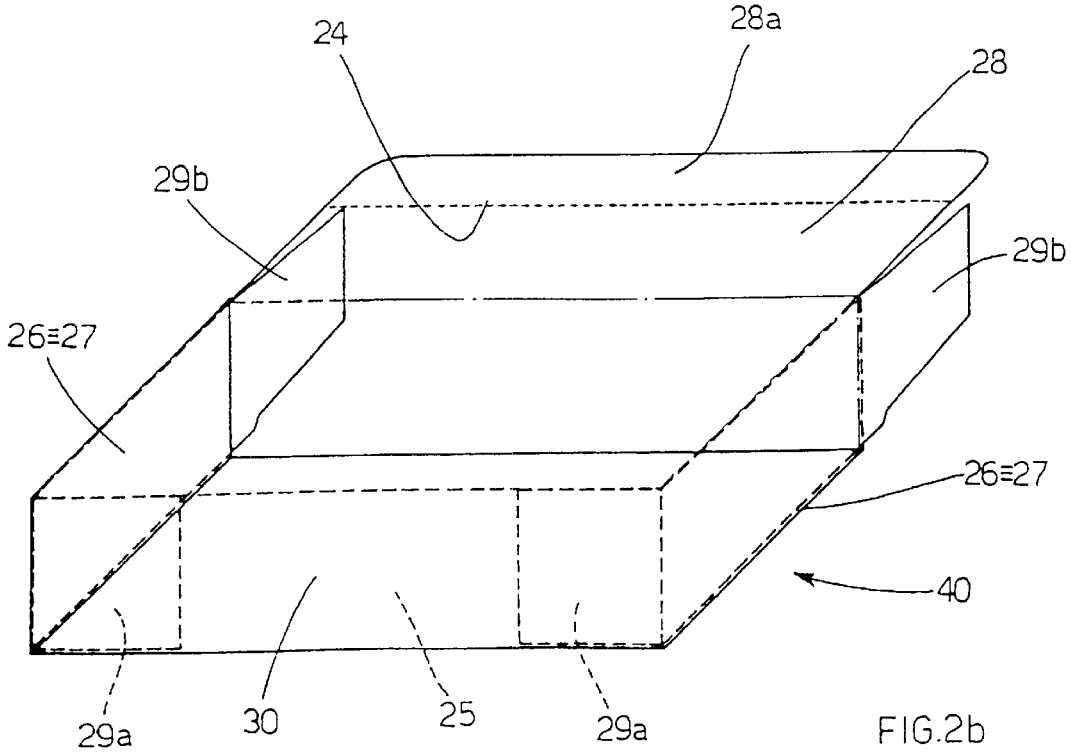
FIG.2b
Fig.2

AUTOMATIC MACHINE FOR THE PREPARATION OF HALF-PACKAGES STARTING FROM CORRESPONDING BLANKS

The present invention regards an automatic machine for the preparation of half-packages starting from corresponding blanks preferably made of cardboard.

BACKGROUND OF THE INVENTION

In the packaging sector, automatic machines are known that box articles inside corresponding cartons or boxes. These cartons or boxes are generally obtained starting from a blank made of cardboard or similar material. For example, in the Italian Patent Application B097A000593, an automatic machine is described in which the blank, suitably configured, is folded directly onto the product to be packaged while the product is being fed along a pre-set path inside the machine itself. Albeit yielding excellent results, the above machine has not, however, proved suitable for the preparation of empty half-packages, which are open on one side through which it is possible to insert, subsequently, a product and, possibly, a corresponding explanatory leaflet.

In this connection it should be said that, in the present context, by "half-package" is meant a blank folded in a cup-like manner and having a substantially a box-like shape in which at least one side is left open for the subsequent introduction of a product, and possibly of a corresponding explanatory leaflet, by means of a further machine set downstream of the automatic machine according to the present invention.

SUMMARY OF THE INVENTION

Consequently, the purpose of the present invention is to provide an automatic machine that is able to produce half-packages of the type described above and has the lowest possible number of moving members.

In addition, in an accessory way, the machine that forms the subject of the present invention may make ample use both of a vacuum and of compressed air distributed on the faces of a mould which is fed along a path defined inside the machine itself.

Since the machine according to the invention has only a limited number of moving members, transition from the starting blank to the corresponding half-package occurs in a very short time, avoiding at the same time the complicated management of the inertia of the moving machine parts.

Furthermore, the machine according to the invention enables simultaneous processing of a plurality of blanks set one after another and being fed along the same path. In addition, the few moving members are simple to build and easy to synchronize together, not requiring complicated electronic programs for managing the movements involved.

Even though in what follows, to facilitate understanding of the present invention, reference will be made to the blank described in the above-mentioned Italian Patent Application B097A000593, it remains understood that the automatic machine described and claimed herein can be used for making half-packages starting from any type of blank. It is evident that, if the type of blank changes, it will be necessary to reprogram at least one part of the steps that make up the cycle of folding of the blank on the mould.

Consequently, according to the present invention it is provided an automatic machine for the preparation of half-packages starting from corresponding blanks preferably made of cardboard, the automatic machine comprising:

a frame;

at least one mould designed to receive a blank;

a feed device for feeding the mould along a pre-defined path; and a plurality of devices set along the path for folding respective portions of the blank on the mould so as to form a corresponding half-package; the automatic machine being characterized in that at least one part of the plurality of folding devices is fixed with respect to the frame and to the feed device and in that a device is provided which is designed to maintain the faces of the mould constantly parallel to themselves at any point of the path.

BRIEF DESCRIPTION OF THE DRAWINGS

The present invention will now be described with reference to the attached drawings, which illustrate a non-limiting example of embodiment of the invention and in which:

FIG. 2 shows a trimetric view of a half-package obtained by folding the blank shown in FIG. 1;

DETAILED DESCRIPTION OF THE INVENTION

Figure 1:
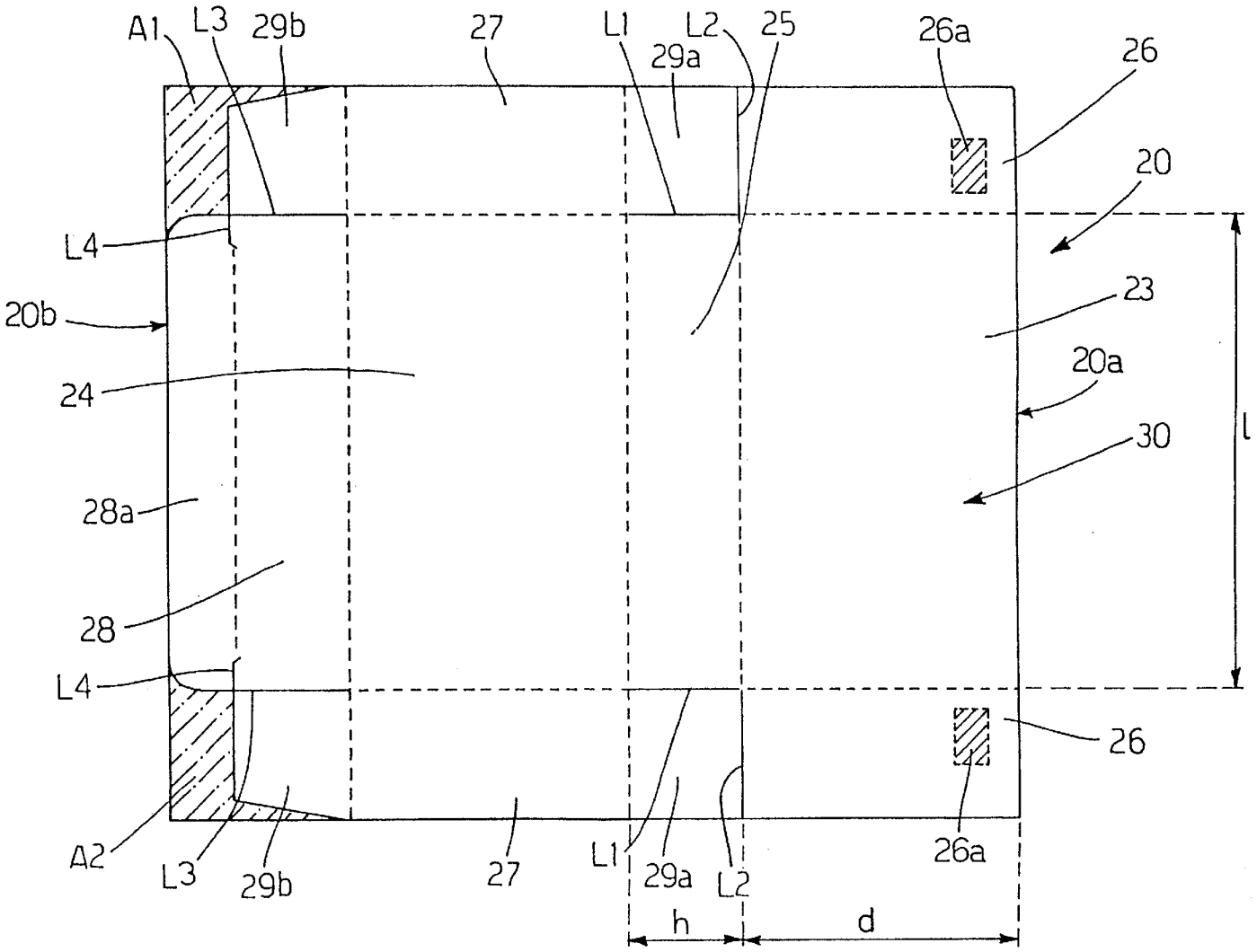
FIG. 1 illustrates a plan view of a blank usable in the machine that forms the subject of the present invention to obtain a corresponding half-package.

Before proceeding to a detailed description of the automatic machine that forms the subject of the present invention, it is necessary to make some remarks about the blank 20 with reference to FIGS. 1 and 2.

This blank 20 has already been amply described in the Italian Patent Application BO97A000593.

The blank 20 illustrated in FIG. 1 is obtained starting from a length 30 of a strip of cardboard (not shown). From the said length of cardboard 30, which has a rectangular shape, the portions A1 and A2, which are at one end of the length of cardboard 30, have been sheared and removed in order to define an outer border, as shown in FIG. 1. In addition, a number of cuts L1, L2, L3, and L4 have been made in the blank 20 by using appropriate devices and by performing deep creases represented by dashed lines in FIG. 1. Moreover, on the blank 20 it is possible to identify a front edge 20*a* and a rear edge 20*b*.

More specifically, the blank 20 comprises a front wall 23 and a rear wall 24 which are joined together along one side by a front side 25 and have, laterally, respective pairs of square end folds 26, 27, which are designed to overlap in the assembly configuration of the half-package 40 (FIG. 2).

On the side opposite to the front side 25, i.e., on the rear wall 24, there is a rear side 28 provided externally with a foldable tab 28*a*, by means of which it is possible to open the complete package (not illustrated). The square end folds 27 have moreover, set transversely to them, respective pairs of small square end folds 29*a*, 29*b* for slotting in, which are a consequence of the cuts L1, L2, L3, L4.

FIG. 2 illustrates the blank 20 folded in such a way as to make a half-opened half-package 40. In particular, the configuration of the half-package 40 shown in FIG. 2 is basically the one obtained at output from the automatic machine that forms the subject of the present invention.

Figures 3, 4, 5:
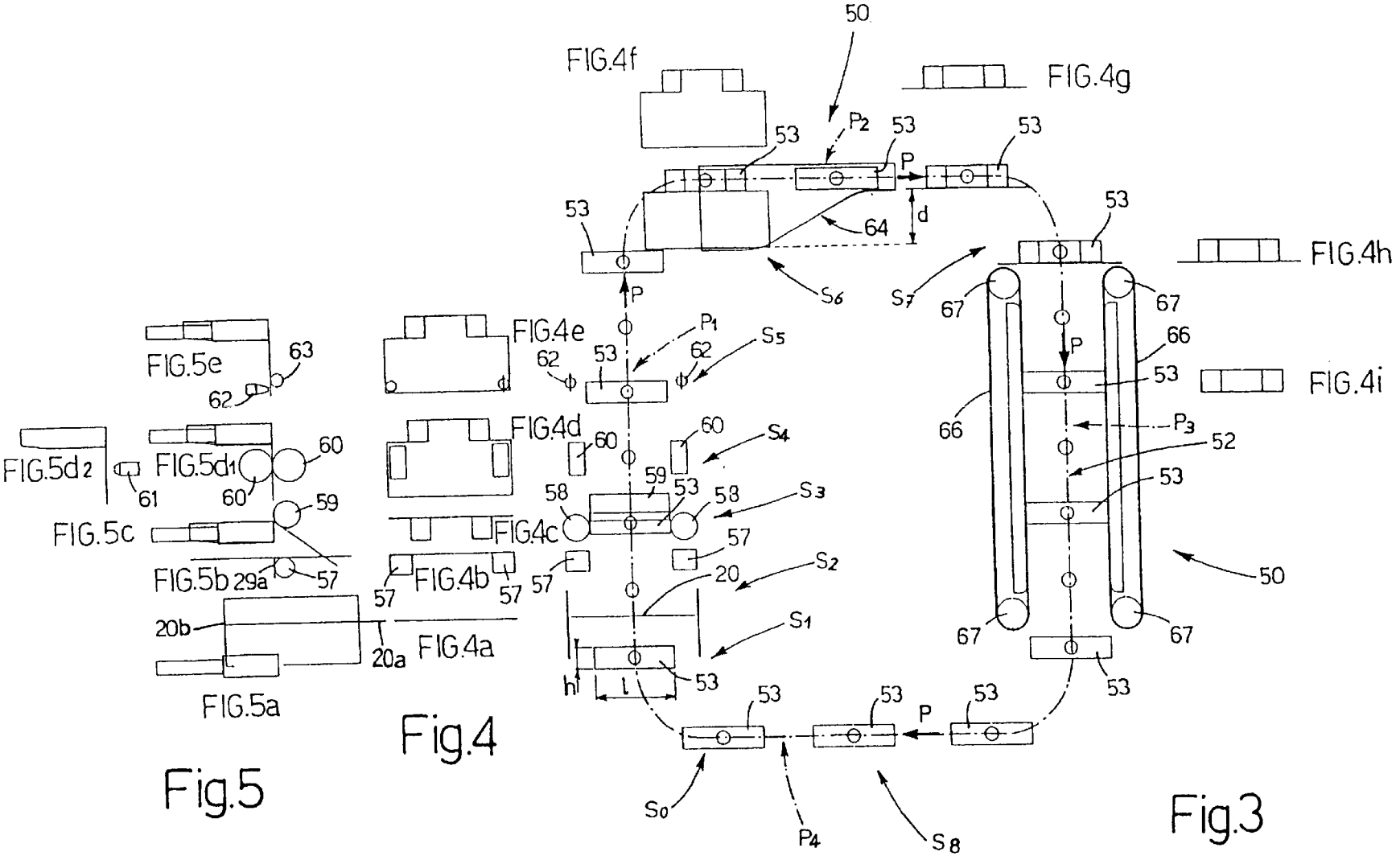
FIG. 3 illustrates a cycle which the blank of FIG. 1 may undergo according to the various devices that make up the machine according to the invention.
FIG. 4 illustrates front views of the blank of FIG. 1 during the various steps of the cycle illustrated in FIG. 3.
FIG. 5 illustrates side views of the blank of FIG. 1 during the various steps of the cycle illustrated in FIG. 3.

In FIG. 3, the reference number 50 designates an assembly diagram of the automatic machine which forms the subject of the present invention, with the aim of illustrating the cycle which a blank 20 must undergo for obtaining a half-package 40 (FIGS. 1 and 2).

For convenience of representation, FIG. 3 shows only some of the members making up the machine 50.

Figure 13:
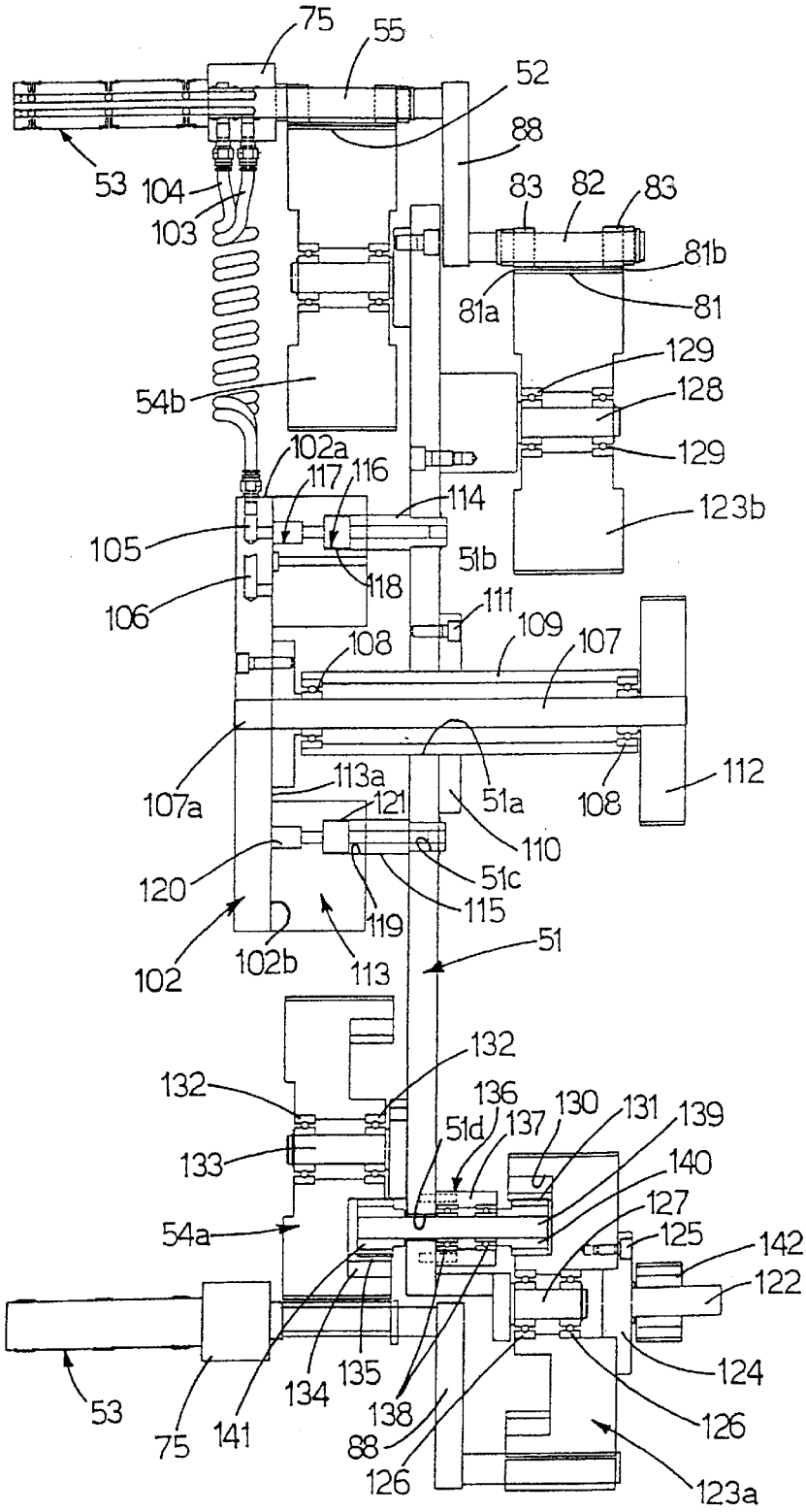
FIG. 13 shows the moving members of the machine illustrated schematically in FIG. 6.

The machine 50 first of all comprises a frame 51 (FIG. 13) designed to support a feed device 52 for feeding a plurality of moulds 53. In the case in point, the feed device 52 is represented by a belt 52, preferably, but not necessarily, made of a plastic material having a certain flexibility, the belt 52 being wound around four snub pulleys 54*a*, 54*b* (FIGS. 6 and 13) set in rotation by means of a device illustrated in greater detail later (FIG. 13). The belt 52 is set in such a way as to cause each mould 53 to travel along a path P in a clockwise direction in the embodiment of FIG. 3.

Associated in an integral way to each mould 53 is a shaft 55, which is idle (FIGS. 7 and 10) with respect to the belt 52 but is supported by the latter by means of a supporting system described hereinafter.

FIGS. 3–5 illustrate in detail the cycle that each mould 53 combined to a respective blank 20 undergoes. At a station $S_0$, the blank 20 has not yet been associated to the corresponding mould 53. The faces 53*a*–53*f* of the mould 53 are translated parallel to themselves by the aforesaid supporting belt 52.

Figure 6:
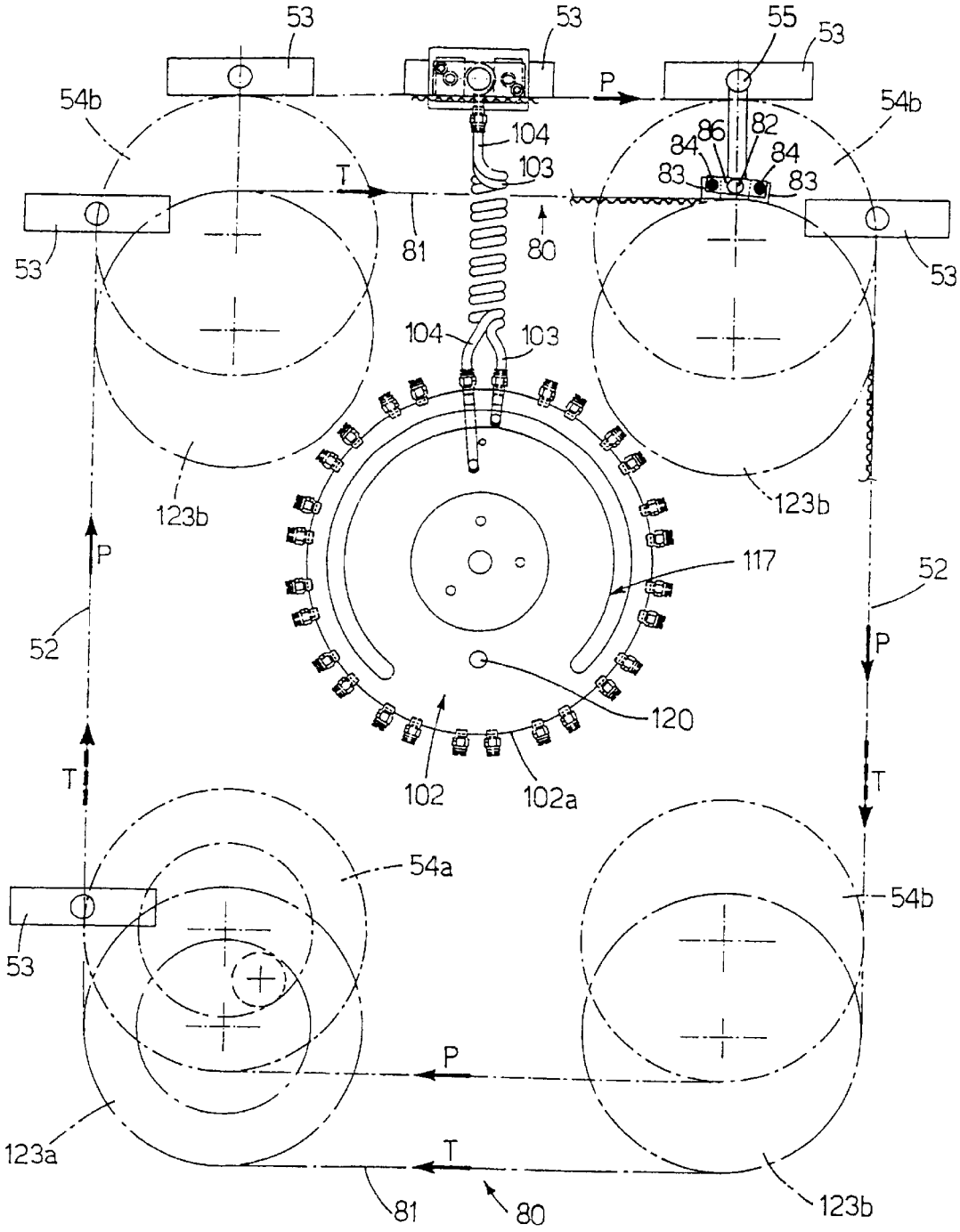
FIG. 6 shows a schematic overall view of the machine according to the invention.

It should be said incidentally that, to perform a translation of the mould 53 along the aforesaid path P in such a way that the faces 53*a*–53*f* of the mould 53 remain constantly parallel to themselves, a particular device is used which will be described in greater detail in what follows (FIG. 6).

Each mould 53 is substantially shaped like a parallelepiped connected in an integral way to the aforementioned shaft 55. Consequently, as shown in greater detail in FIGS. 7–10, each mould 53 has a top face 53*a*, a bottom face, 53*b*, a front face 53*c*, two side faces 53*d*, 53*e*, and a rear face 53*f* which is connected in an integral way to the aforementioned shaft 55.

At least the top face 53*a* and the bottom face 53*b* are provided with pneumatic means for the creation of suction-cup gripping points 56*a* and 56*b*, respectively, on these two surfaces, whilst the front surface 53*c* can be provided with an outlet for compressed air, for purposes that will emerge more clearly in the sequel.

Proceeding in the analysis of the path P shown in FIG. 3, after the station $S_0$, a station $S_1$ is provided, at which the first contact between the blank 20 and a mould 53 occurs. In particular, the blank 20 is inserted crosswise to the path P by means of a mechanical device (not shown), which is in itself known, so as to encounter the top face 53*a* of the mould 53, which, in the meantime, is translating along the path P, being drawn along by the belt 52 (FIG. 4*a*). As shown in FIG. 5*a*, the blank 20 is inserted in such a way that its rear edge 20*b* (FIG. 1) is at a point corresponding to the corner edge formed by the intersection of the two faces 53*a*, 53*f* of the mould 53.

It is also evident that if the blank 20 is positioned with respect to the mould 53 in such a way that the cuts L1, L2, L3, L4 and the deep creases represented by the dashed lines (FIG. 1) facilitate folding of the various portions of the blank 20 on the corresponding moulds 53 to obtain the desired half-package 20 (FIG. 2).

When the station $S_1$ is reached, also blocking of the blank 20 on the top face 53*a* of the mould 53 occurs by means of the above-mentioned plurality of top suction cups 56*a* (FIGS. 7 and 8) connected, via suction pipes, to a vacuum generator (not shown).

The way in which the vacuum is distributed on the faces 53*a*, 53*b* will be better described in what follows (FIGS. 6–13).

Figure 7:
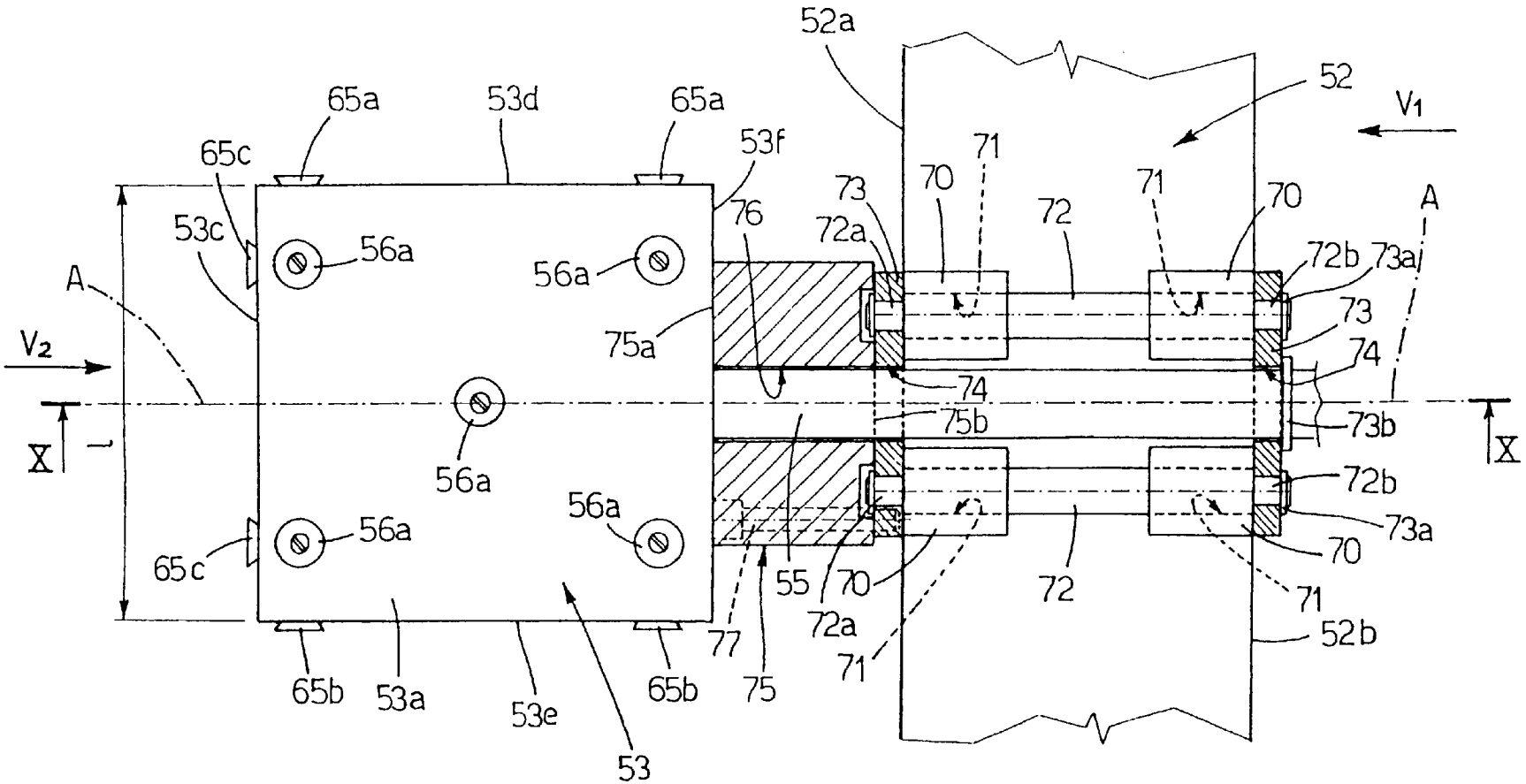
FIG. 7 shows a plan view of the mould combined with the corresponding vacuum and compressed-air distributor illustrated in FIG. 3.

As shown in FIGS. 3 and 7, the mould 53 has a width 1 substantially equal to that of the portions 23, 24, 25, 28, 28*a* of the blank 20 (FIG. 1), in such a way that on its top face 53*a* the portions 24, 28, 28*a* of the blank 20 rest and are withheld as a result of the vacuum applied to the suction cups 56*a*. In addition, as has already been said, the rear edge 20*b* of the blank 20 must be at the edge of intersection between the top face 53*a* and the rear face 53*f* of the mould 53.

At this point the blank 20, which is gripped to the corresponding mould 53 as a result of the suction action of the suction cups 56*a*, proceeds in its travel along the path P and reaches a station $S_2$, where the small square end folds 29*a* are folded by means of a pair of rollers 57 set laterally with respect to the mould 53. The small square end folds 29*a* thus set themselves perpendicular to the face 53*a* of the mould 53. Consequently, the blank 20 assumes the configuration represented in FIGS. 4*b* and 5*b*.

As shown again in FIGS. 3, when a station $S_3$ is reached, simultaneous folding of the square end folds 27 and small square end folds 29*b* is performed by means of a pair of rollers 58, the said square end folds 27 and 29*b* thus being set perpendicular to the face 53*a* of the mould 53, and hence also perpendicular to the portions 24, 28, 28*a* of the blank 20. At the same station S3, by means of a roller 59 set transversely with respect to the aforementioned pair of rollers 58, the front wall 23, the front side 25, and the square end folds 26 of the blank 20 are folded at 90° with respect to the face 53*a* (FIG. 1).

Advantageously, as shown in FIGS. 3 and 7, the height of the mould 53 must be equal to the width h of the front side 25 and of the square end folds 29*a* of the blank 20 (FIG. 1), so that both the front side 25 and the square end folds 29*a* may rest completely against the front face 53*c* of the mould 53. The new configuration of the blank 20 with respect to the mould 53 is shown in FIGS. 4*c* and 5*c*.

Proceeding in the journey along the path P, at the station $S_4$ the external surfaces of the square end folds 26 undergo marking. The operation of marking the data on the package (date, place, etc.) can be carried out by means of two pairs of marking rollers 60, as in the solution shown in FIG. 5*$d_1$*, or else by means of a pair of marking nozzles 61 (only one being shown in FIG. 5*$d_2$*), each of which is designed to spray an ink jet on the respective square end fold 26, as in the embodiment illustrated in FIG. 5*$d_2$*.

In a station $S_5$, instead, an adhesive substance is applied, by means of a pair of gumming nozzles 62, on the internal surfaces of the same square end folds 26 that in the station $S_4$ had been marked externally. To facilitate application of the adhesive, it is possible to provide also contrast elements 63 (only one being shown in FIG. 5*e*), each being set on the opposite side of the respective gumming nozzle 62.

As shown in FIG. 1, an adhesive area 26*a* is consequently formed on each one of the internal surfaces of the square end folds 26.

As may be noted observing FIG. 3, between the station $S_1$ and the station $S_5$ the mould 53 travels along a substantially vertical branch $P_1$ of the path P, at the same time maintaining the top face 53*a* constantly parallel to itself.

After the station $S_5$, the mould 53 starts to move horizontally, again as a result of it being drawn along by the belt 52, along a branch $P_2$ which is substantially horizontal and set in series with respect to the above-mentioned branch $P_1$.

In a station $S_6$, which is situated at the beginning of the stretch $P_2$, is provided an inclined plane 64, which is the hypotenuse of a right-angle triangle having a height d equal to the height of the front wall 23 and of the square end folds 26.

In the horizontal translation of the mould 53, with the corresponding faces 53*a*–53*f* constantly parallel to themselves, the front wall 23 and the square end folds 26 meet the inclined plane 64, which folds them at 90° with respect to the face 53*c* of the mould 53. As shown in FIG. 7, the bottom face 53*b* of the mould 53 is provided with the aforesaid suction cups 56*b* which undergo the action of a vacuum-generating device (not illustrated). The said suction cups 56*b* enable reversible blocking of the front wall 23 of the blank 20 on the bottom face 53*b* of the mould 53.

The configurations of the blank 20 with respect to the mould 53 before and after the action on the blank 20 of the inclined plane 64 are represented in FIGS. 4*f* and 4*g*, respectively.

Subsequently, the blank 20 conveyed by the respective mould 53 arrives in a station $S_7$, from which a third branch $P_3$, which is substantially vertical and parallel to the first branch $P_1$, starts. At this point, the blank 20, with respect to the corresponding mould 53, is configured as shown in FIGS. 4*g* and 4*h*. In the station $S_7$, then, the square end folds 26 are set horizontally. The internal surfaces of the said square end folds 26 having the adhesive areas 26*a* are ready to be folded towards the external surfaces of the square end folds 27, each of which lies on a respective side face 53*d*, 53*e* of the mould 53.

To ensure blocking of the square end folds 27 on the side faces 53*d*, 53*e*, also the latter may be provided with respective suction cups 65*a*, 65*b* (FIGS. 7–9) connected to the same vacuum-generating system to which the aforesaid suction cups 56*a*, 56*b* are connected, as will emerge more clearly later on.

In order to achieve the desired 90° fold of the square end folds 26, provided on the branch $P_3$ is a pair of belts 66 which are motor-driven by means of pulleys 67 and of mechanical means that are not illustrated in FIG. 3. The said belts 66 accompany the movement of descent of the moulds 53 at the same linear speed as the feed speed of the moulds 53 themselves along the path P, so as to prevent any scratching on the external surfaces of the folded blank 20.

In an embodiment which is not illustrated, the belts 66 may be idle on the pulleys 67.

The belts 66 not only enable folding of each square end fold 26 on the respective square end fold 27, but press the square end folds 26, 27 against each other, so facilitating gluing of the internal surface of each square end fold 26 on the external surface of the respective square end fold 27, thanks to the respective adhesive area 26*a* (FIG. 1). In this way, the half-package 40 shown in FIGS. 2 and 4*i* is obtained.

To accelerate the gluing process, the third vertical branch $P_3$ of the path P may be equipped with a drying device (not illustrated) of any kind, for example a generator of hot air.

Half-way along a fourth branch $P_4$ and at a station $S_8$, the half-package 40 is ejected from the mould 53 by means of a jet of compressed air coming out of a mouth 68 (FIGS. 9 and 10) provided on the front face 53*c* of the mould 53.

In greater detail, the jet of compressed air issuing from the mouth 68 acts on the bottom of the half-package 40, which is made up of the front side 25 and the two small square end folds 29*a* superimposed on the said front side 25, so sliding the half-package 40 out of the mould 53 and causing the rear wall 24, the rear side 28, and the tab 28*a* to slide on the face 53*a*, the front wall 23 to slide on the face 53*b*, and the internal surface of each square end fold 27 to slide on the side faces 53*d*, 53*e*.

As has already been said, in series to the branch $P_3$, a further branch $P_4$ is provided, which is horizontal and parallel to the branch $P_2$. In this branch $P_4$ the mould 53, by now without the half-package 40 since, as has been said, the latter has been unloaded in the station $S_8$, is fed by the belt 52 towards the station $S_0$, and is ready to resume a new cycle for producing a new half-package 40. In practice, the path P, which consists of the four branches $P_1$, $P_2$, $P_3$, and $P_4$ set in series one after another, has a substantially rectangular form on the plane of the sheet.

It is evident that all the operations carried out in the stations $S_0$–$S_8$ can be governed and controlled by means of an electronic control unit (not shown).

As has been said previously, it has been necessary to find a system for fixing the mould 53 to the belt 52 in such a way as to enable drawing-along of the mould 53 by the belt 52, but also to enable at the same time a rotation of the mould 53 with respect to the belt 52 itself. In order to do this, the solution illustrated in FIGS. 7 and 10 has been adopted.

Fixed by gluing on the belt 52 are four blocks 70, preferably, but not necessarily, made of plastic material, each of which is traversed by a respective through hole 71, the axis of symmetry of which is parallel to an axis A of longitudinal symmetry of the mould 53 and of the shaft 55 (FIGS. 7 and 10) and is transverse with respect to the direction of advance of the belt 52. The four blocks 70 are glued in twos at the edges 52*a*, 52*b* of the belt 52.

The four blocks 70 can be considered as two separate pairs, each of which is made up of a first block 70 located on the edge 52*a* and a second block 70 located on the edge 52*b*. A respective spindle 72 traverses a pair of through holes 71 and protrudes slightly with respect to the two edges 52*a*, 52*b*. The ends 72*a* of the spindles 72 located on the side where there is the edge 52*a* are joined together by a plate 73, and likewise the ends 72*b* that are located at the edge 52*b*.

Each plate 73, in turn, is provided with a respective through hole 74, which may be traversed by the aforesaid shaft 55, the shaft 55 being integral with the mould 53. The spindles 72 are fixed to the respective plates 73 by means of Seeger rings 73*a*, whereas for the shaft 55 a Seeger ring 73*b* is provided.

As shown again in FIGS. 7 and 10, between the mould 53 and the edge 52*a* of the belt 52 there is a vacuum and compressed-air distributor 75 connected to a distribution device, as shall be described in greater detail hereinafter.

Figure 8:
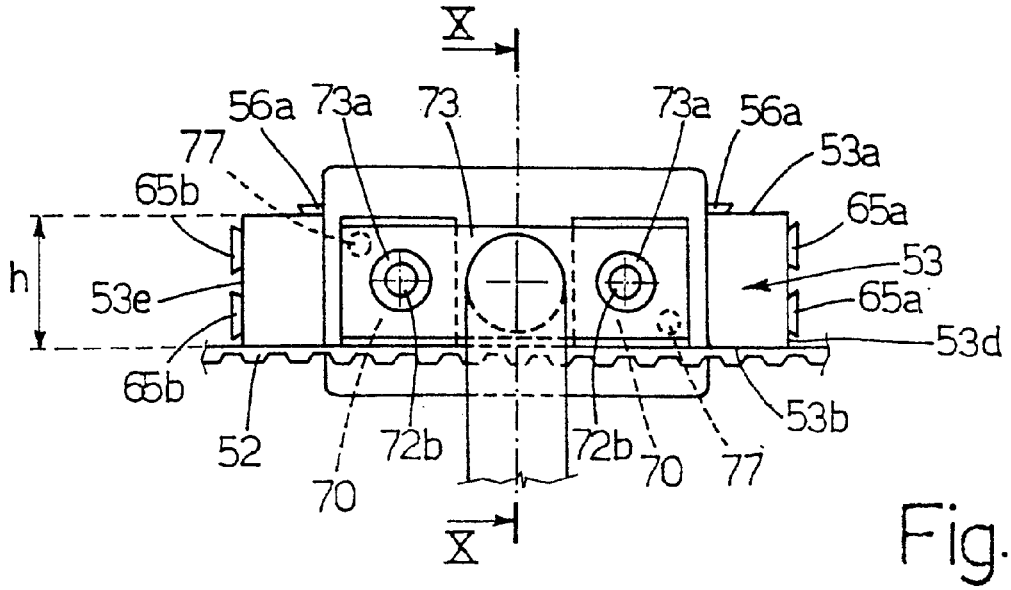
FIG. 8 shows one first front view, according to the arrow $V_1$, of a mould combined with a corresponding vacuum and compressed-air distributor illustrated in FIG. 7.
Figure 9:
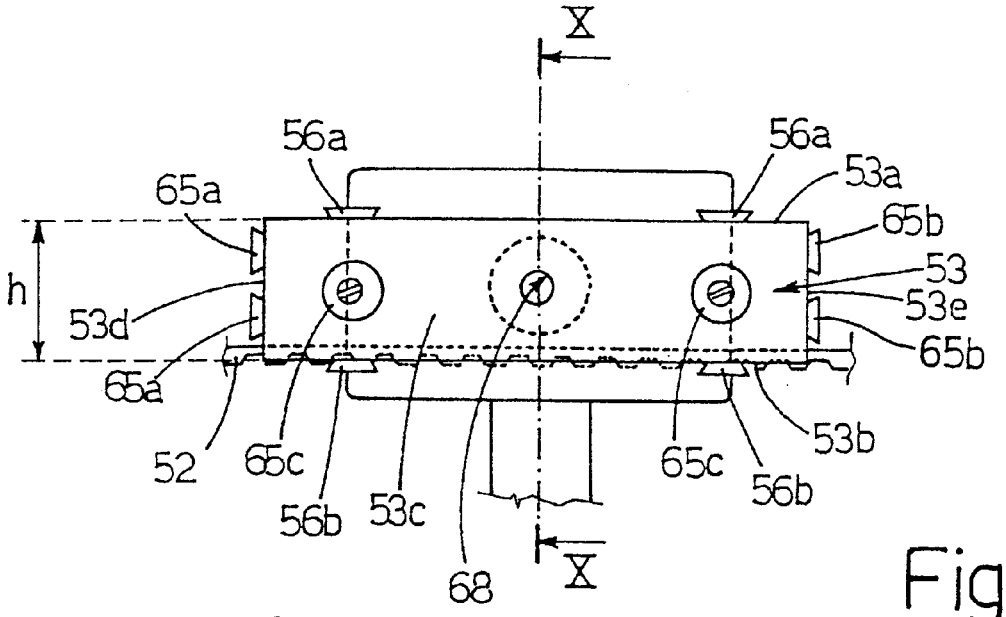
FIG. 9 illustrates a second front view, according to the arrow $V_2$, of a mould combined with a corresponding vacuum and compressed-air distributor illustrated in FIG. 7.

The distributor 75 has a through hole 76 traversed by the shaft 55, which, as has been said, is integral with the mould 53. In addition, the distributor 75 is rendered integral with the plate 73 facing the side where there is the edge 52*a* by means of a pair of screws 77 (FIGS. 7 and 8). Consequently, the distributor 75 is idle with respect to the shaft 55, but is integral with the plates 73, and hence, in practice, with the belt 52.

For the aforementioned reasons, it is necessary, during translation of the mould 53 along the aforesaid path P, whilst each face 53*a*–53*f* of the mould 53 remains constantly parallel to itself, to cause the distributor 75 to follow, instead, the path of the belt 52. In this way, a relative rotation of the distributor 75 with respect to the mould 53 is achieved, this rotation enabling, according to a procedure which will be described in greater depth in what follows, the distribution of the vacuum or of the compressed air over the faces 53*a*–53*e* of the mould 53.

As has already been mentioned, the machine 50 has a device 80 (FIG. 6) to ensure that, during translation of the mould 53 along the aforesaid path P, each face 53*a*–53*f* of the mould 53 remains constantly parallel to itself.

This device 80, represented in greater detail in FIG. 6 and removed for reasons of clarity from FIG. 3, is itself also integral with the frame 51 (FIG. 13) and comprises, in one of its particular embodiments, a second belt 81, which defines a path T (FIG. 6). On this belt 81, for each mould 53 is provided a system for fixing a shaft 82 similar to the shaft 55 seen in connection with the belt 52.

In fact, fixed by gluing on the belt 81 are four blocks 83 (only two being shown in FIG. 6—see also FIGS. 10 and 13), preferably, but not necessarily, made of plastic material, each of which is traversed by a respective through hole, the axis of symmetry of which is parallel to the aforementioned axis A. The four blocks 83 are glued in twos at the edges 81*a*, 81*b* of the belt 81.

The four blocks 83 can be considered as two separate pairs, each of which is made up of a first block 83 located on the edge 81*a* and a second block 83 located on the edge 81*b*. A respective spindle 84 (FIG. 6) traverses a pair of through holes and protrudes slightly with respect to the two edges 81*a*, 81*b*. The ends of the spindles 84 located on the side where there is the edge 81*a* are joined together by a plate 86 (FIG. 6), as likewise are the ends that are located at the edge 81*b*.

Each plate 86, in turn, is provided with a respective through hole 87 which may be traversed by the aforesaid shaft 82.

Figure 10:
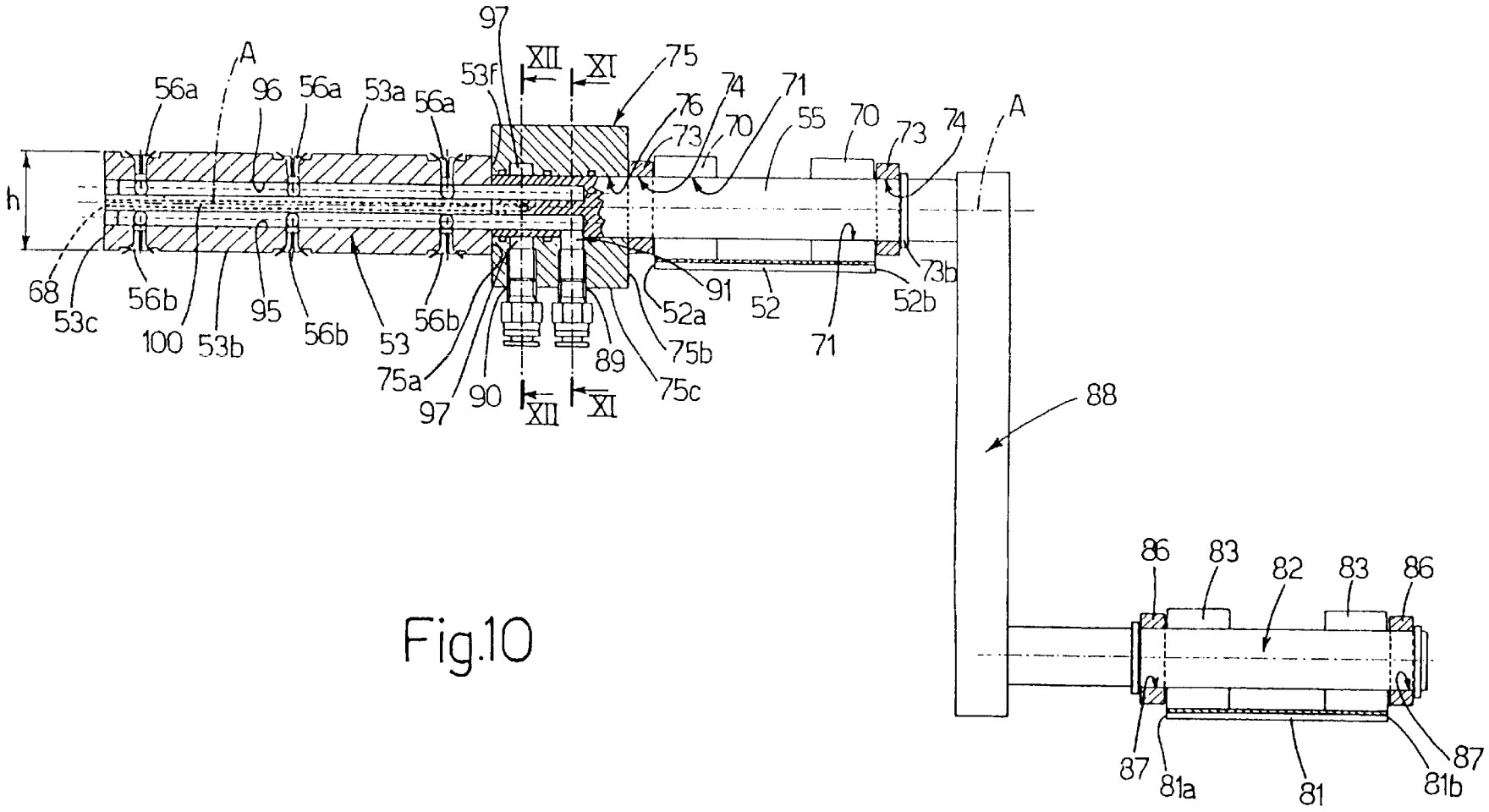
FIG. 10 is a longitudinal sectional view of the devices represented in the foregoing FIGS. 7–9, taken along the line X—X.

The shafts 55 and 82 are connected in an integral way together by means of a connecting rod 88 (FIGS. 10 and 13).

The connecting rod 88, the shaft 82, and the shaft 55, which is integral with the mould 53, have a configuration defined by the position occupied by the device 80 with respect to the belt 52, whilst the length of the connecting rod 88 depends upon the distance between the belt 52 and the device 80.

As shown in particular in FIGS. 7–10, the distributor 75 has a substantially parallelepipedal structure and has a front face 75*a* resting on the face 53*f* of the mould 53, a rear face 75*b* connected to the plates 73 by means of the screws 77 and a bottom face 75*c* (FIG. 10) provided both with an opening 89 for connection of the distributor 75 with the vacuum generator (see later) and of an opening 90 for connection with a compressed-air generator (see later).

It is evident that, instead of the aforesaid belt device 80, any other device that is suitable for the purpose may be used, such as a guide which extends substantially parallel to the belt 52 and on which a pad mechanically connected to the shaft 55 may slide.

Figure 11:
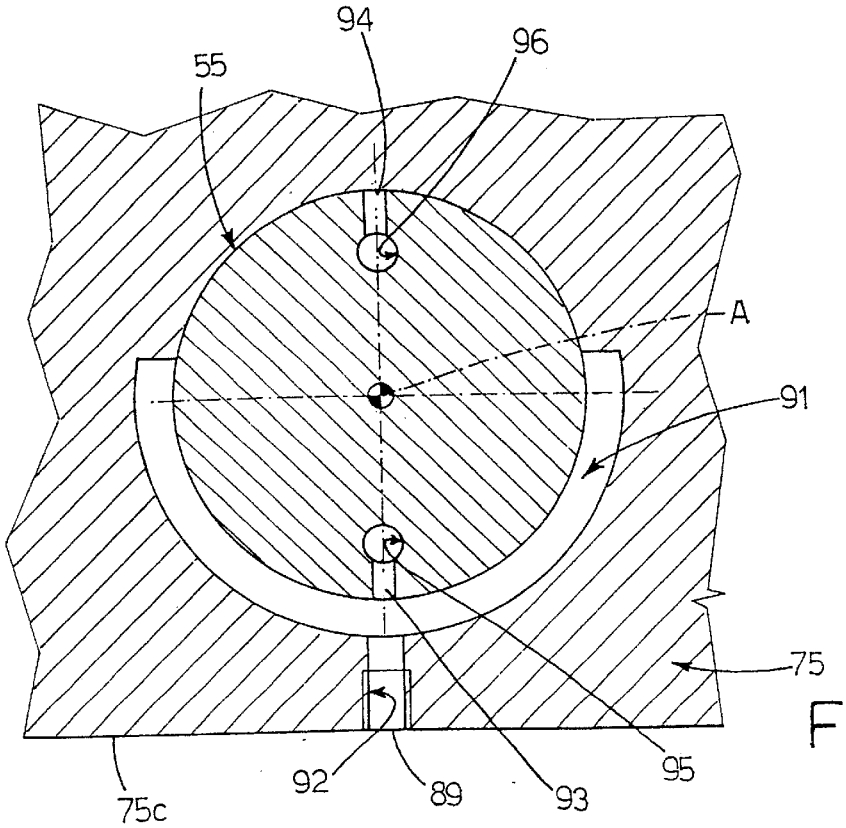
FIG. 11 is a cross-sectional view (at a different scale), along the line XI—XI, of the vacuum and compressed-air distributor illustrated in FIG. 10.
Figure 12:
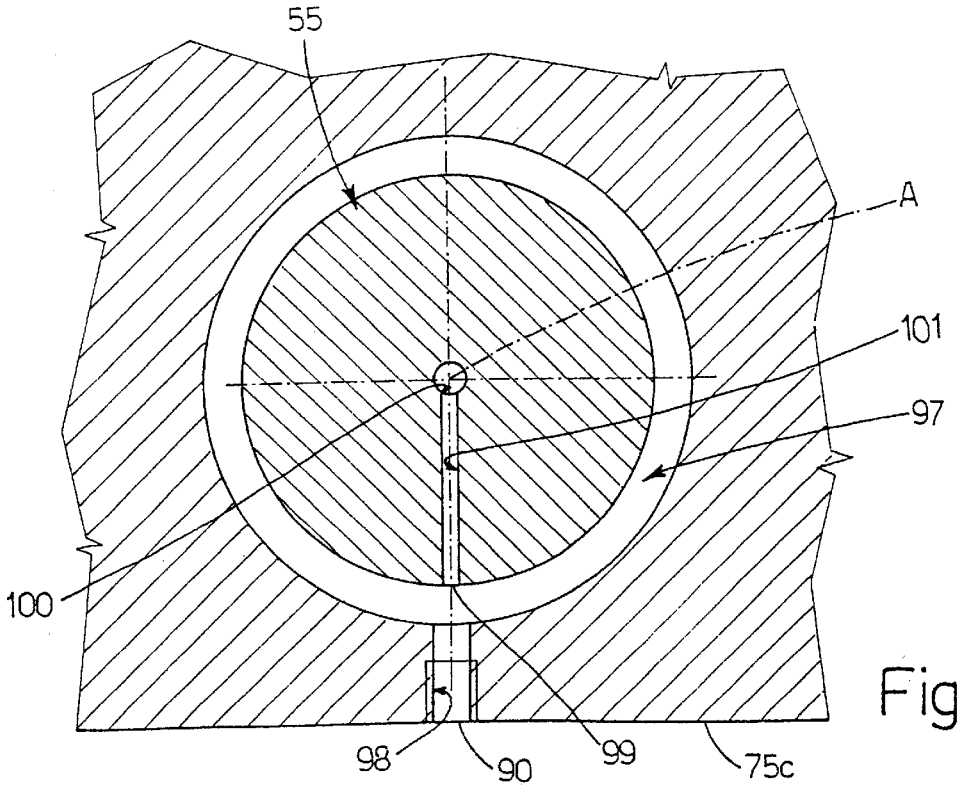
FIG. 12 is a cross-sectional view (at a different scale), along the line XII—XII, of the vacuum and compressed-air distributor illustrated in FIG. 10; and finally

FIG. 10 and FIGS. 11 and 12 show, respectively, a vacuum-distribution system and a pressurized-air system controlled by the distributor 75.

In fact, as regards vacuum distribution inside the distributor 75, a semi-annular channel 91 is provided, which is in continuous pneumatic connection with the opening 89 via a threaded hole 92, whilst the shaft 55 is provided, at its periphery, with a pair of inlets 93, 94 set at 180° with respect to one another, each being connected to a pipe 95, 96 of its own which creates a vacuum, respectively, on the bottom face 53*b* and on the top face 53*a* of the mould 53 (FIG. 10).

As is shown in greater detail in FIG. 11, the relative rotation of the distributor 75 with respect to the shaft 55, which, as already said, is integral with the mould 53, sets the inlet 93 and/or the inlet 94 in pneumatic communication, and in a possibly selective way, so creating suction of the suction cups 56*b* or of the suction cups 56*a*, respectively, on the desired portions of the blank 20. In other words, from the fluid-dynamics standpoint, the semi-annular channel 91 and the inlets 93, 94 can work as a two-way valve. It is evident that, for both the pipes 95, 96 to be able to work simultaneously, the angle of opening of the semi-annular channel 91 must exceed 180°. The width of this angle is determined by the law that governs opening and closing of the pipes 95, 96, so as to have instants along the path P at which the vacuum is created simultaneously on the faces 53*a*, 53*b*.

It is evident that the other suction cups present on the other faces 53*c*, 53*d*, 53*e* of the mould 53 can be pneumatically connected to the pipes 95, 96 according to the portions of the blank 20 that are to undergo suction on the various faces 53*c*–53*e*, as represented in the cycle of FIG. 3.

The system for distribution of compressed air is similar to the system described for the vacuum.

In fact, as illustrated in FIGS. 10 and 12, inside the distributor 75 an annular channel 97 is provided, which is pneumatically connected to the opening 90 via a channel 98. On the shaft 55, an inlet 99 is provided which is pneumatically connected to a pipe 100, parallel to the axis A, by means of a channel 101 perpendicular to the axis A. The pipe 100 leads to the aforesaid mouth 68. The compressed air can therefore be sent to the mouth 68 to carry out the desired ejection of the half-package 40 at the station S8 shown in FIG. 3.

As shown in FIG. 12, the opening 90 is connected to the annular channel 97 by means of a threaded hole 98.

As illustrated in FIGS. 6 and 13, in order to create a vacuum or to deliver compressed air on the faces 53*a*–53*e* of the mould 53, the distributor 75 is pneumatically connected to a distributor disk 102 set in rotation at the same speed as the belts 52, 81 through means which will be illustrated in greater detail in what follows.

For this purpose, the openings 89, 90 located on the face 75*c* of the distributor 75 are pneumatically connected, by means of respective coiled elastic tubes 103, 104, each to a respective pipe 105, 106 which is basically L-shaped (FIG. 13). The pipes 105, 106, starting from the outer edge 102*a* of the distributor disk 102, let out onto a face 102*b* of the distributor disk 102 itself.

The distributor disk 102 is supported by the frame 51 by means of a shaft 107 which is integral with the frame and is supported by a pair of bearings 108 inside a sleeve 109. The sleeve 109 traverses a through hole 51*a* provided in the frame 51 and, in turn, is rendered integral with the frame 51 by means of a flange 110 fixed to the frame 51 with screws 111 (only one screw being shown in FIG. 13). The shaft 107 has one first end 107*a*, at which the above-mentioned distributor disk 102 is fixed using traditional methods, and one second end 107*b* on which a pulley 112 is fitted, which is set in rotation by a toothed belt in a way which will be described in greater detail in the sequel.

As shown in FIG. 13, the system for distribution of the vacuum and compressed air on the faces 53*a*–53*e* of the mould 53 further comprises a fixed disk 113 which is rendered integral with the frame 51 by means of a pair of rigid cups 114, 115 and of a pin (not shown in FIG. 10) set at 120° with respect to each other.

The cup 114 passes through a hole 51*b* provided on the frame 51 and is fixed to the latter by screwing. The cup 114 hydraulically connects a vacuum generator (not illustrated) with a pipe 116, which in turn is in communication with a semi-annular groove 117 (see also FIG. 6) made out of the face 113*a* of the fixed disk 113, the said groove 117 following for a stretch the form of the edge 102*a* of the distributor disk 102.

In order for one face 113*a* of the fixed disk 113 to be constantly pressed against the face 102*b* of the distributor disk 102, the end of the cup 114 that is inserted in the pipe 116 is provided with a helical spring 118.

Likewise, the cup 115 passes through a hole 51*c* provided in the frame 51 and is fixed to the latter by screwing. The cup 115 hydraulically connects a compressed-air generator (not illustrated) with a pipe 119, which in turn is in communication with a port 120 (see also FIG. 6) provided on the face 113*a* of the fixed disk 113.

In order for the face 113*a* of the fixed disk 113 to be constantly pressed against the face 102*b* of the distributor disk 102, the end of the cup 115 that is inserted in the pipe 119 is provided with a helical spring 121.

Also to the aforementioned pin (not shown), which, as has been said, completes the set of three elements for fixing the fixed disk 113 to the frame 51, there is associated a respective spring (not illustrated) for purposes similar to those already seen for the springs 118 and 121, which are associated, respectively, to the cup 114 and to the cup 115.

In use, the distributor disk 102 is set in rotation by means of the pulley 112 in a way whereby its face 102*b* slides on the face 113*a* of the fixed disk 113. Meanwhile, the pipe 105, which is associated to a respective coiled elastic tube 103, is periodically set in communication with the semi-annular groove 117 provided on the fixed disk 113 to create, when so desired, a vacuum on the faces 53*a*–53*e* of the mould 53 only for a stretch of the path P (FIG. 3). Operation of the suction cups 56*a* or of the suction cups 56*b* is controlled, as has been seen, by the distributor 75 during its rotation with respect to the shaft 55 which is integral with the mould 53. Possibly, by means of pipes (not illustrated) connected to the pipes 95, 96 for vacuum distribution (FIG. 10), it is possible to activate the above-mentioned suction cups 65*a*, 65*b*, located, respectively, on the face 53*d* and on the face 53*e*, or else pads 65*c* associated to the face 53*c*, to carry out the entire cycle of suction of portions of the blank 20 on the said faces 53*c*–53*e* for at least one part of the path P (FIG. 3).

Following the rotation of the distributor disk 102, which rotates with respect to the fixed disk 113, the pipe 106, connected to the coiled elastic tube 104, enters into fluid connection with the port 120, through which the compressed air coming from the cup 115 and the pipe 119, which are set in series, passes. Consequently, at the instant at which the outlet of the pipe 106 on the face 102*b* comes into contact with the port 120, on the face 113*a* a jet of compressed air is generated, which, via the coiled elastic tube 104 and the pipe 100, is sent, as has been seen, to the mouth 68 located on the face 53*c* to bring about ejection of the half-package 40, as has been shown in connection with the station $S_8$ of FIG. 3.

It should be said incidentally that compressed air is generated continuously but does not come of the port 120, because the said port 120 is closed by the face 102*b* of the distributor disk 102, except for the instant in which, as has been said, during rotation of the distributor disk 102 with respect to the fixed disk 113, the outlet of the channel 106 on the face 102*b* of the distributor disk 102 coincides with the port 120 provided on the face 113*a* of the fixed disk 113.

In addition, particular care must be paid in making the surfaces 102*b* and 113*a* so that their reciprocal sliding does not generate heat due to friction which would be harmful to proper operation of the vacuum and compressed-air distribution systems.

With particular reference to FIG. 13, the mechanisms moving the two belts 52, 81 and the system of rotation of the distributor disk 102 will now be illustrated.

As has already been said, the belts 52, 81 and the distributor disk 102 must have values of their peripheral speeds that are substantially the same for two effects to be obtained: accompanying of the belt 52 by the belt 81 in order to achieve the desired effect of parallelism of the faces 53*a*–53*f* with respect to themselves during translation of the mould 53 along the path P (FIG. 3), and the following of the respective mould 53 by each pair of tubes 103, 104. It is evident that the tubes 103, 104 are made of an easily deformable plastic material wound in coils so that they may follow the respective mould 53 also in the corner portions of the path P, i.e., in the points of transition from the branch $P_1$ to the branch $P_2$, from the branch $P_2$ to the branch $P_3$, etc.

Rotation of the moving parts of the machine 50 is generated by a driving shaft 122 being rotated by means of a motor assembly (not shown). The driving shaft 122 is connected to a first toothed driving pulley 123*a* by means of a circular plate 124 and a plurality of screws 125 (only one of which is illustrated in FIG. 13). In addition, the first driving pulley 123*a* is idle on a pair of bearings 126 supported by a spindle 127 rendered integral with the frame 51 by known mechanical means.

Furthermore, since the first driving pulley 123*a* is toothed, it is able to set the belt 81, which is also toothed, in motion. As has been seen, the belt 81 connects the first driving pulley 123*a* with a set of three pulleys 123*b* (only one of which is shown in FIG. 13) located at the corners of the path T of the belt 81, the path T substantially coinciding with the path P (FIG. 3) of the mould 53.

Each pulley 123*b* is supported by a spindle 128 fixed with known means to the frame 51 via a pair of bearings 129. As will be recalled, the shaft 82 ,which is integral with the connecting rod 88, the shaft 55 and the mould 53, is fixed to the belt 81.

The pulleys 123*b* have outer diameters equal to the diameter of the first driving pulley 123*a*.

As shown again in FIG. 13, on the face of the first driving pulley 123*a* set facing the frame 51, a recess 130 is made, which is provided with an internal toothing 131.

On the side opposite to the first driving pulley 123*a* with respect to the frame 51, a second toothed driving pulley 54*a* is located, this driving pulley being shaped in a way similar to the first driving pulley 123*a*.

This second driving pulley 54*a* is supported by a pair of bearings 132 fitted on a spindle 133 fixed to the frame 51 with known mechanical means. Also for the second driving pulley 54*a*, which is toothed externally to perform pulling of the belt 52, a recess 134 is provided, which is equipped with a corresponding internal toothing 135.

In order to transmit motion between the first driving pulley 123*a* and the second driving pulley 54*a*, a device 136 for transmission of motion is made, which is set astride the frame 51. This device 136 comprises a bushing 137 which is fixed with known means to the frame 51 and which carries inside it a pair of bearings 134 fitted on a spindle 139. The spindle 139 is inserted in a hole 51*d* which traverses the frame 51. In addition, at each one its two ends the spindle 139 is provided with a respective pinion gear 140, 141, each of which meshes, respectively, with the internal crown gear 131 of the pulley 123*a* and with the internal crown gear 135 belonging to the pulley 54*a*.

The toothed pulley 54*a* sets in motion the toothed belt 52, which also passes through the set of three snub pulleys 54*b*, which are also located at the corners of the path P.

By means of the device 136, the two driving pulleys 123*a*, 54*a* are made to rotate in the same direction, so as to advance the shaft 82 along the path T in the same direction as the mould 53, which, as has been said, travels along the path P in the clockwise direction.

A further pulley 142 is fitted on the motion-input driving shaft 122 so as to obtain the aforementioned rotation of the toothed pulley 112, and hence of the distributor disk 102, by means of a toothed belt (not shown). It is evident that rotation of the pulley 142 is simultaneous with rotation of the driving pulleys 123*a* and 54*a*.

To sum up, by setting the driving shaft 122 in motion, the pulleys 123*a*, 54*a* and 142 are set in rotation simultaneously and in the same direction, and in turn set in motion, respectively, the belt 81, the belt 52, and the distributor disk 102 with the same peripheral speed. In this way, the desired effect is obtained of following of the mould 53 by the shaft 82 and of the distributor disk 102 together with the corresponding tubes 103, 104, which distribute, respectively, the vacuum and compressed air on the faces 53*a*–53*e* of the mould 53.

The advantages of the present machine are the following:

a limited number of devices with moving parts, wherein a particular device is provided which is designed to maintain the faces of the mould constantly parallel to themselves at any point of the path; therefore, it is possible to adjust the different devices in a suitable manner in order to handle moulds and the relevant blanks presenting different dimensions;

ease of synchronization of movements between advance of the mould together with the corresponding blank, and folding of the portions of blank on the faces of the mould;

reliability of blocking of the portions of blank on the faces of the mould, this reliability being due to the selective use of the vacuum on the faces;

selective distribution of the vacuum and of compressed air on the faces of the mould by means of a distribution device of simple conception but high reliability, which conveniently exploits the movement of the mould itself along a given path to selectively distribute the vacuum and/or compressed air according to the various stations occupied by the mould and by the corresponding blank along its path; and finaly;

noiseless operation and almost absolute absence of vibrations of the mechanical parts;

possibility of getting a number of moulds, set one after another, to travel simultaneously along the same path so as to occupy at the same time all the stations of the path with a mould provided with a corresponding blank; in the illustrated embodiment it is consequently possible to process nine blanks simultaneously at the nine stations provided, with a consequent reduction in the times of passage from the blank to the half-package.

What is claimed is:

1. An automatic machine for the preparation of half-packages starting from corresponding blanks made of cardboard, the automatic machine comprising:

a frame;

at least one mould provided with pneumatic means designed to receive a blank;

a feed device for feeding said at least one mould along a first pre-defined path (P); and a plurality of first devices set along said first path (P) for folding respective portions of said blank on said at least one mould so as to form a corresponding half-package;

the automatic machine being characterized in that at least part of said plurality of first devices is fixed with respect to said frame and to said feed device and in that a second device is provided which is designed to maintain faces of said at least one mould constantly parallel to themselves at any point of said first path (P).

2. An automatic machine as per claim 1, in which said second device includes a first belt designed to follow a second path (T), said second path (T) being substantially parallel to said first path (P) followed by said at least one mould.

3. An automatic machine as per claim 1, in which said at least one mould is provided with pneumatic means for withholding, in a selective manner, on walls portions of said blank so as to form a half-package.

4. An automatic machine as per claim 3, designed to fold the blank on the at least one mould to obtain the half-package, said blank comprising a front wall and rear wall, which are joined together along one side by a front side and have respective first and second pairs of square end folds, and further comprise a pair of slot-in small square end folds set between said first square end folds and said second square end folds; the automatic machine being characterized in that it further comprises along the first path (P):

means for folding said pairs of slot-in small square end folds;

means for folding the second pair of square end folds;

means for folding the front side and for a first folding of the rear wall and of the first pair of square end folds;

means for applying an adhesive substance on internal surfaces of the first pair of square end folds;

means for marking said first pair of square end folds;

means for a second folding of the rear wall and of the first pair of square end folds; and means for a third folding of the first pair of square end folds on the second pair of square end folds so that each of the first square end fold is glued on the respective second square end fold.

5. An automatic machine as per claim 3, in which said half-package is ejected at the end of the first path (P) by means of a jet of compressed air.

6. An automatic machine as per claim 5, in which a vacuum and compressed air are distributed in a selective manner by an assembly comprising a plurality of third devices.

7. An automatic machine as per claim 6, in which said assembly comprises a first disk, which is fixed, and a second disk, which is mobile with respect to said frame, a first face of said second disk resting on a second face of said first disk during rotation of said second disk with respect to said first disk.

8. An automatic machine as per claim 7, in which said second disk is pneumatically connected with the at least one device of said plurality of third devices via a pair of coiled elastic tubes.

9. An automatic machine as per claim 7, in which said first disk is pushed against said second disk by elastic means.

10. An automatic machine as per claim 6, in which at least one part of said plurality of third devices move in synchronism with the movement of said at least one mould along said first path (P).

11. An automatic machine as per claim 10, in which at least one device of said plurality of third devices for distribution of the vacuum and compressed air is idle on a first shaft integral with said at least one mould, and in which the at least one device of said plurality of third devices can rotate with respect to said first shaft so as to perform the desired selective distribution of the vacuum and compressed air on the faces of the at least one mould.

12. An automatic machine as per claim 11, in which the at least one device of said plurality of third devices is provided inside with a semi-annular channel for distribution of the vacuum and with an annular channel for distribution of compressed air on a first face of the faces of said at least one mould.

13. An automatic machine as per claim 12, in which said first shaft is provided on its external surface with inlets which can enter into pneumatic communication with said semi-annular channel to create the vacuum on a bottom face and/or on a top face of the faces of said at least one mould.

14. An automatic machine as per claim 13, in which said top and bottom faces are provided with respective suction cups to withhold portions of said blank.

15. An automatic machine as per claim 14, in which said suction cups are pneumatically connected to said inlets by means of respective pipes.

16. An automatic machine as per claim 15, in which said pipes are pneumatically connected with suction cups provided, respectively, on second, third, and fourth faces of the faces of said at least one mould.

17. An automatic machine as per claim 11, in which said first shaft integral with the at least one mould is supported by a second belt by means of a pair of plates supported by two pairs of blocks glued to said second belt.

18. An automatic machine as per claim 17, in which said shaft is free to rotate with respect to said second belt.

19. An automatic machine as per claim 18, in which said first shaft and said first belt are connected together by means of a connecting rod and a second shaft which is drawn by said first belt but is free to rotate with respect to said first belt.

20. An automatic machine as per claim 19, in which the at least one mould, the first shaft, the connecting rod, and the second shaft are integral with one another.

21. An automatic machine as per claim 20, in which said second belt is set in motion by first pulleys, said first belt is set in motion by second pulleys, and said second disk is set in rotation by a pair of third pulleys connected together by a means of a third belt.

22. An automatic machine as per claim 21, in which the first, second, and third pulleys are set in rotation by means of a single driving shaft.

23. An automatic machine as per claim 22, in which a first driving pulley of said second belt and a second driving pulley of said first belt have respective first and second internal toothings connected together by a third device.

24. An automatic machine as per claim 23, in which said third device comprises a spindle, the ends of which have a respective pinion gear, each of which meshes, respectively, with the first internal toothing and with the second internal toothing.

* * * * *